US006644947B2

(12) United States Patent
Cavanaugh

(10) Patent No.: US 6,644,947 B2
(45) Date of Patent: Nov. 11, 2003

(54) WAVE TOOTH GEARS USING IDENTICAL NON-CIRCULAR CONJUGATING PITCH CURVES

(75) Inventor: Craig Cavanaugh, Fort Wayne, IN (US)

(73) Assignee: Tuthill Corporation, Burr Ridge, IL (US)

( * ) Notice: Subject to any disclaimer, the term of this patent is extended or adjusted under 35 U.S.C. 154(b) by 0 days.

(21) Appl. No.: 10/097,292

(22) Filed: Mar. 14, 2002

(65) Prior Publication Data

US 2003/0175141 A1 Sep. 18, 2003

(51) Int. Cl.[7] ..... F04C 2/18; F16H 55/08; G01F 3/10

(52) U.S. Cl. ..... 418/206.5; 418/150; 73/261; 74/462

(58) Field of Search ..... 418/150, 206.5; 73/261; 74/462

(56) References Cited

U.S. PATENT DOCUMENTS

| | | | | |
|---|---|---|---|---|
| 231,939 | A | 9/1880 | Shedd | 73/261 |
| 386,795 | A | 7/1888 | Ball | 73/253 |
| 1,833,159 | A | 11/1931 | Garnett | 74/462 |
| 2,368,019 | A | 1/1945 | Guibert et al. | 418/206.5 |
| 2,897,765 | A | 8/1959 | Kitano | 418/206.5 |
| 3,709,055 | A | 1/1973 | Grove | 74/462 |
| 4,036,073 | A | 7/1977 | Kitano | 74/393 |
| 4,270,401 | A | 6/1981 | Davidson | 74/462 |
| 4,640,149 | A | 2/1987 | Drago | 74/462 |
| 4,867,002 | A | 9/1989 | Bouchet | 74/462 |
| 4,911,010 | A | 3/1990 | Foran, Jr. et al. | 73/261 |
| 4,943,214 | A * | 7/1990 | Niimura et al. | 418/150 |
| 4,996,888 | A | 3/1991 | Foran, Jr. et al. | 73/261 |
| 5,114,325 | A | 5/1992 | Morita | 418/171 |
| 5,135,373 | A | 8/1992 | Cozens | 418/190 |
| 5,297,945 | A | 3/1994 | Loubier et al. | 418/206.5 |
| 5,325,715 | A | 7/1994 | Foran, Jr. et al. | 73/261 |
| 5,415,041 | A | 5/1995 | Foran, Jr. et al. | 73/261 |
| 5,545,871 | A | 8/1996 | Carr | 219/69.17 |
| 5,695,425 | A | 12/1997 | Hashimoto et al. | 475/180 |
| 6,048,186 | A | 4/2000 | Kitano | 418/190 |
| 6,164,944 | A | 12/2000 | Martin et al. | 418/171 |

FOREIGN PATENT DOCUMENTS

| | | | | |
|---|---|---|---|---|
| GB | 2114701 | * | 8/1983 | 418/206 |

OTHER PUBLICATIONS

"The Math of Noncircular Gearing", Gear Technology Magazine, Jul./Aug., 2000 (William C. Smith).
"When you need Noncircular Gears", Product Engineering Magazine, Mar. 14, 1960.

* cited by examiner

*Primary Examiner*—John J. Vrablik
(74) *Attorney, Agent, or Firm*—Barnes & Thornburg

(57) ABSTRACT

This invention is directed to a novel wave tooth gear having a non-circular pitch curve and uniform wave teeth to create a tighter seal between meshing gears. The non-circular wave tooth gear has a major axis and a minor axis disposed perpendicular to the major axis, wherein the major axis is longer than the minor axis and includes a central hub, a plurality of teeth radially extending from the hub at locations surrounding the hub and a plurality of roots, each root positioned between adjacent teeth at locations surrounding the gear. The teeth include a head portion shaped as an arc segment of a first radius and the roots include a recess shaped as an arc segment of a second radius. The teeth heads are joined to adjacent roots by lines of tangency.

27 Claims, 4 Drawing Sheets

WAVE TOOTH GEARS USING IDENTICAL NON-CIRCULAR CONJUGATING PITCH CURVES

BACKGROUND OF THE INVENTION

The present invention relates generally to gears and more particularly to novel wave gears having non-circular conjugating pitch curves and including uniform gear teeth and roots to create a tighter seal between meshing gears.

PRIOR ART

Gears used for measuring the volume of fluid flow in meters or transferring fluid in pumps are typically circular or non-circular meshing gears. In a meter, the gears are positioned within a fluid chamber of a meter housing and are journaled to seal the gear teeth against the inner walls of the chamber. The fluid chamber includes intake and outlet ports to allow for the ingress and egress of fluid. Typical meshing gears used in fluid measuring or transferring devices utilize involute gear teeth that are machined or molded to properly mesh, creating a seal between the gears. The seal created by the meshing gear teeth prevents the passage of fluid. The gears in a meter work by passing a volume of pressurized fluid through the fluid chamber. The number of revolutions of the gears is used to determine the amount of fluid that has passed through the chamber. The accuracy of the meter or pump is directly related to how well the gears are able to seal against each other and the fluid chamber. If the seal is inconsistent throughout the full revolution of the gears, the measuring device will be inaccurate since fluid will leak past the gears without producing the corresponding revolutions. Involute tooth gears, due to the inaccuracies in design, do not provide an adequate seal for precise metering between meshing gears and can agitate shear sensitive fluids. Involute tooth forms for oval gears are non-uniform throughout the perimeter of the gear and require excessive undercutting and clearances to prevent binding. This excessive undercutting and non-uniform tooth shape leads to a tooth form that does not have uniform strength and sealing surfaces around the gear's profile. Sharp corners around teeth form high stress concentration points that weaken the gear. Gears formed with involute teeth also have varying accuracy when used for flow meters due to fluid leakage between the gear teeth, especially at low fluid flow rates. Prior art gears do not provide for a design that creates a tight seal between gear teeth to precisely measure fluid flow at low rates and reduce fluid agitation and shear.

SUMMARY OF THE INVENTION

This invention may be described as a novel wave tooth gear having a non-circular pitch curve and uniform wave teeth to create a tighter seal between meshing gears so as to provide precision metering. The term "wave tooth" as used herein refers to a tooth profile, which if extended linearly, would result in a repeating wave pattern. The non-circular or oval wave tooth gear has a major axis and a minor axis disposed perpendicular to the major axis, wherein the major axis is longer than the minor axis. The wave tooth gear includes a central hub, a plurality of wave teeth radially extending from the gear at locations surrounding the gear and a plurality of roots, each root positioned between adjacent teeth at locations surrounding the gear. The teeth include a head portion shaped as an arc segment having a first radius and the roots include a recess shaped as an arc segment having a second radius. The teeth heads are joined to adjacent roots by lines of tangency.

Teeth and roots formed about the perimeter of the non-circular wave tooth gear are wave shaped and offer many design and manufacturing advantages. The gears have a uniform backlash throughout gear rotation due to the ability to accurately design the placement and shape of the gear teeth and roots. The wave tooth gears can be designed using Computer Aided Drafting technology, which allows the design to be easily transferred to part manufacturers. The geometric shape of the gear renders the gear easy to manufacture and prototype. Shapers and hobbing machines are not required to manufacture the gear. Meshing wave tooth gears have less sliding contact than gears of other designs, which reduces noise, wear and frictional losses. The reduced sliding contact between gears reduces the heating of metered fluid and lessens the impact on shear sensitive fluids. Hydraulic leakage between mating gears is also reduced because of a tight and consistent seal between gears. Also, the gear teeth are stronger because they are shorter and are void of sharp corners. The shorter tooth depth and lack of sharp corners allow the gears to be easily molded and extruded. The wave tooth gives the wave tooth gear a constant tooth pitch because the teeth are the same width. This makes evaluation of the velocity profile of the meshing gears easier.

These and other aspects of this invention are illustrated in the accompanying drawings and are more fully described in the following specification.

DETAILED DESCRIPTION OF THE INVENTION

While the present invention will be described fully hereinafter with reference to the accompanying drawings, in which a particular embodiment is shown, it is understood at the outset that persons skilled in the art may modify the invention herein described while still achieving the desired result of the invention. Accordingly, the description which follows is to be understood as a broad informative disclosure directed to persons skilled in the appropriate arts and not as limitations of the present invention.

Figure 1:
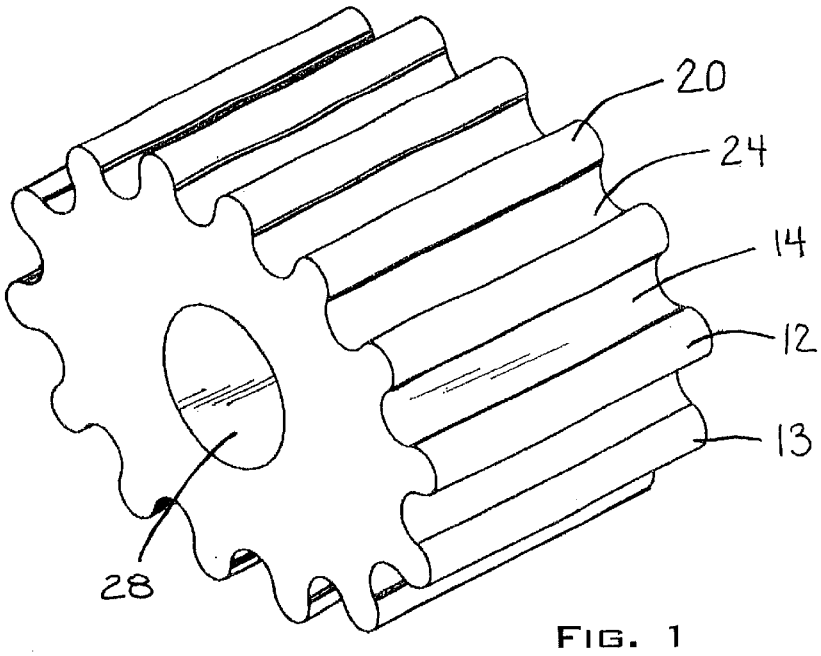
FIG. 1 is a perspective view of a non-circular gear of the present invention having wave teeth and roots disposed about its perimeter.
Figure 2:
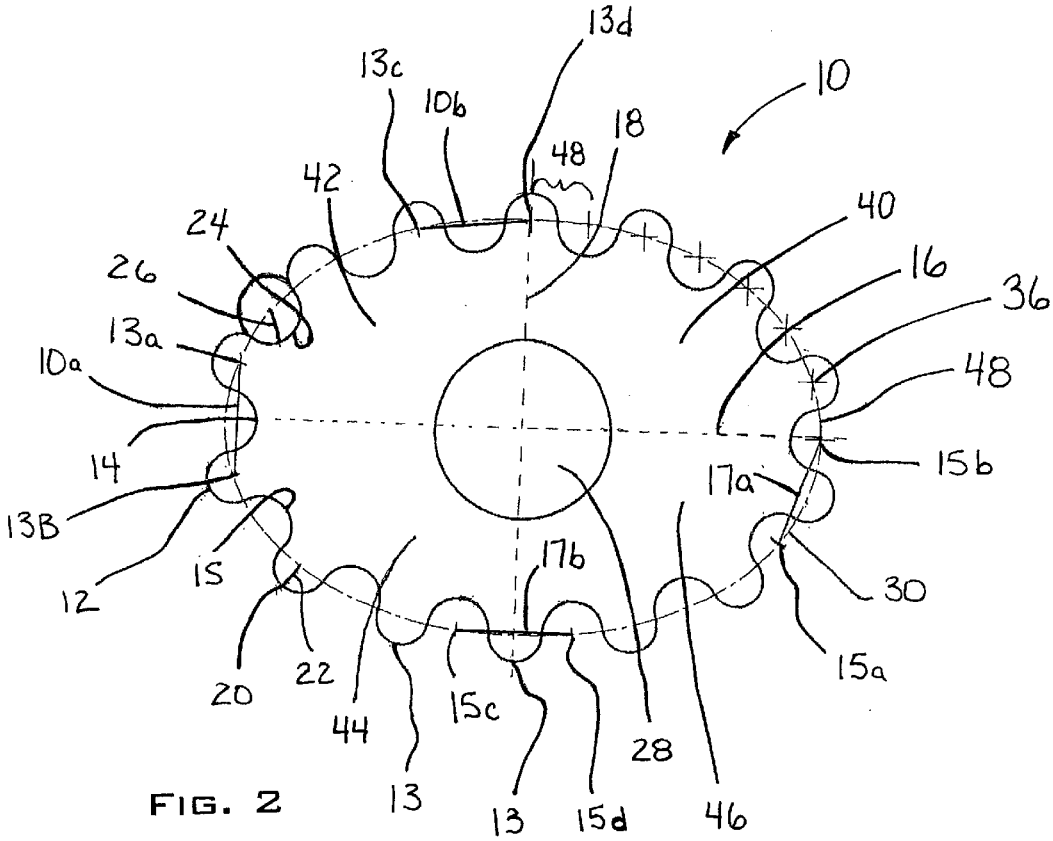
FIG. 2 is an end view of the non-circular gear and illustrating the non-circular pitch curve.

FIGS. 1 and 2 illustrate a non-circular oval wave tooth gear 10 having a plurality of wave teeth 12 and a plurality of roots 14 formed about the perimeter of the wave tooth gear 10. As best shown in FIG. 2, the non-circular wave tooth gear 10 has a major axis 16 and a minor axis 18 disposed perpendicular to the major axis 16, wherein the major axis 16 is longer than the minor axis 18. Each root 14 of the wave tooth gear 10 is positioned between adjacent teeth 12 at locations surrounding the periphery of the gear 10. The teeth 12 and roots 14 are centered along a pitch curve 30 illustrated in dotted lines in FIG. 2. The teeth 12 include a head portion 20 shaped as an arc segment having a first radius 22 shown in FIG. 2 extending from the pitch curve 30 to the centerpoint 13 of the tooth 12. Each wave tooth 12 has a centerpoint 13, the center of which is spaced an equal arcuate distance from the centerpoint 13 of the next tooth 12. The centerpoint 13 is the location that defines the midpoint of the tooth arc segment. While the centerpoints 13 of the wave teeth 12 are spaced an equal arcuate distance apart, the linear distance 10*a* between the centerpoints 13*a* and 13*b* of a first pair of wave teeth 12 is not equal to the lineal distance 10*b* from the centerpoints 13*c* and 13*d* of a second pair of wave teeth 12 due to the placement of the wave teeth 12 in relation to the major 16 and minor 18 axes. The linear distance between the centerpoints 13 of teeth 12 will vary around the perimeter of the gear 10 due to the changing radius of curvature of the pitch curve 30. Wave teeth 12 located closer to the major axis 16 have a smaller linear distance between teeth 12 than wave teeth 12 located closer to the minor axis 18.

The roots 14 of the gear 10, as shown in FIGS. 1 and 2, have recesses 24 shaped as an arc segment having a second radius 26. Each root 14 has a centerpoint 15 the center of which is spaced an equal arcuate distance from the center point 15 of the next root 14. The centerpoint 15 is the location that defines the midpoint of the root arc segment. The roots 14 are spaced an equal arcuate distance apart but the linear distance 17*a* from the centerpoint 15*a* and 15*b* of one pair of roots 14 is not equal to the lineal distance 17*b* from the centerpoints 15*c* and 15*d* of the second pair of roots 14 due to their placement in relation to the major 16 and minor 18 axes. The roots 14 located closer to the major axis 16 will have a smaller linear distance between roots 14 than roots 14 located closer to the minor axis 18.

The wave tooth gear 10 also includes an aperture 28 that passes through the center of the wave tooth gear 12 and is adapted to accept bearings, bushings and/or a shaft about which the gear rotates. The aperture 28 allows the wave tooth gears 12 to be positioned within a housing 34 for metering or pumping fluid.

Figure 3:
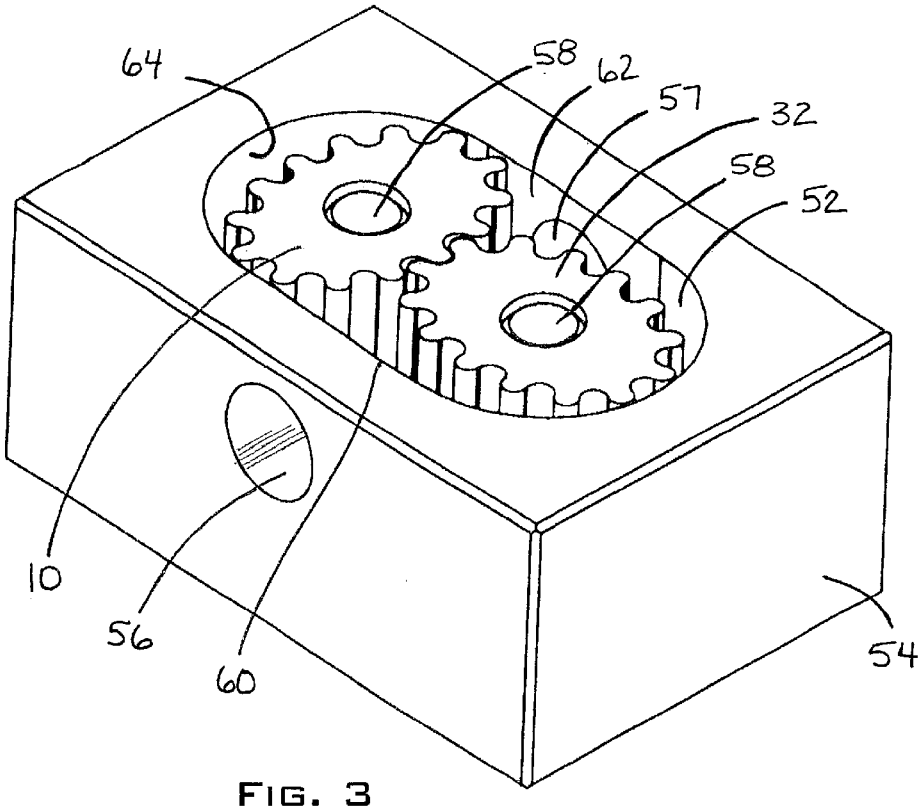
FIG. 3 is a perspective view of a pair of meshing non-circular gears positioned within a fluid housing.
Figure 4:
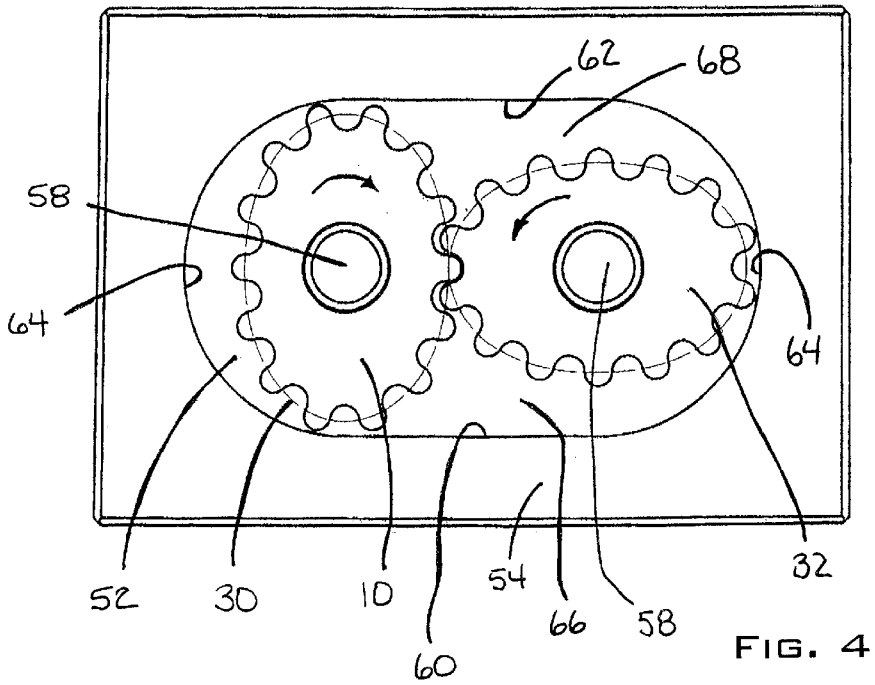
FIG. 4 is an end view of the pair of meshing non-circular gears positioned within the fluid housing.

FIGS. 3 and 4 illustrate a pair of wave tooth gears 10 that have non-circular conjugating pitch curves 30 positioned within a fluid chamber 52 of a housing 54. The housing 54 includes the fluid chamber 52, an inlet 56, an outlet 57, the first and second wave tooth gears 10 and 32 and a pair of gear support shafts 58 A and B. The fluid chamber 52 is oval in shape and includes a first side wall 60 adjacent to the inlet 56 and a second side wall 62 adjacent to the outlet 57. The distance between the first side wall 60 and the second side wall 62 is great enough to allow for the passage of wave teeth 12 at opposite ends of the major axis 16 and rotation of the wave tooth gears 10 and 32, but close enough to prevent leakage of fluid between the teeth 12 along the major axis 16 and the fluid chamber 52. The fluid chamber 52 also includes end walls 64 of arcuate shape that are shaped to be in close proximity to the wave teeth 12 along the major axis 16 of the gear 10. Fluid trapped within the root 14 along the major axis 16 is retained in the root 14 by the seal created between the wave teeth 12 and the end walls 64. The wave tooth gears 10 and 32 are positioned within the fluid chamber 52 so the minor axis 18 of the first gear 10 is aligned with the major axis 16 of the second gear 32. Fluid flows into a high pressure side 66 of the fluid chamber 52 through the inlet 56. The first gear 10 is rotated clockwise and the second gear 32 is rotated counterclockwise so that the fluid is transferred from the high pressure side 66 of the fluid chamber 52 to the low pressure side 68 along the end walls 64. The meshing of the two gears 10 and 32 creates a long, tight leak free path resulting in a better seal to prevent short circuiting of the fluid back to the high pressure side 66 between the gears. Fluid then flows from the fluid chamber 52 through the outlet 57. In a fluid meter arrangement this results in precise metering such that for every revolution of a gear a precise volume of fluid has passed between the inlet and outlet.

Figure 5:
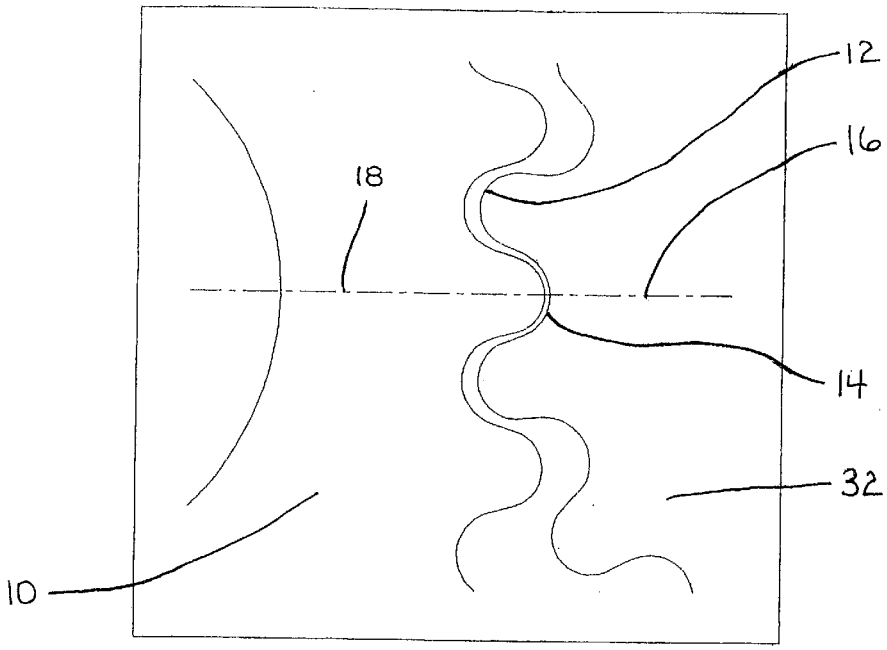
FIG. 5 is a magnification of the teeth and roots of the pair of meshing non-circular gears.

FIG. 5 is a magnification of two meshing gears 10 and 32 illustrating the fluid seal between the gear teeth 12 and roots 14. The arcuate shape of the gear teeth 12 and roots 14 allows the interengagement of teeth 12 and roots 14 on opposing gears 10 and 32 to squeeze fluid out of the roots 14 and retain the fluid on the low pressure side 68 of the fluid chamber 52. The radius 22 of the wave teeth 12 is slightly less than the radius 26 of the roots 14 allowing for variances in bearing tolerances and fluid viscosities.

Figure 6:
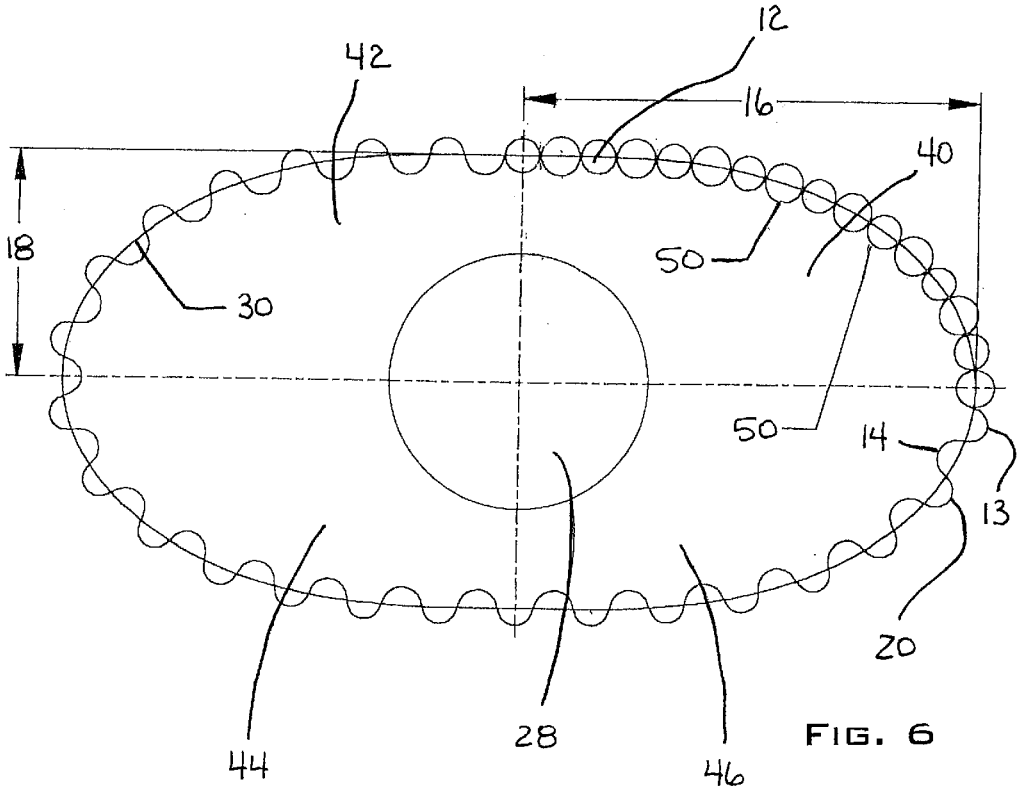
FIG. 6 is a side view of a non-circular gear having a larger major axis and minor axis than the gear of FIG. 2 with imaginary circles added to show gear design.

FIG. 6 illustrates a larger wave tooth gear 10 that has a major axis 16, which is substantially greater than the minor axis 18. The gear 10 includes thirty teeth 12 that surround the gear 10. The first quadrant 40 of the gear 10 illustrates the gear teeth 12 and roots 14 in the form of circles 50 of a given diameter. The circles are used for design purposes only and are removed when the gear teeth 12 and roots 14 are interconnected by lines of tangency as shown in the remaining quadrants 42, 44 and 46. The design of the gear teeth 12 and roots 14 will be discussed in more detail below.

Figure 7:
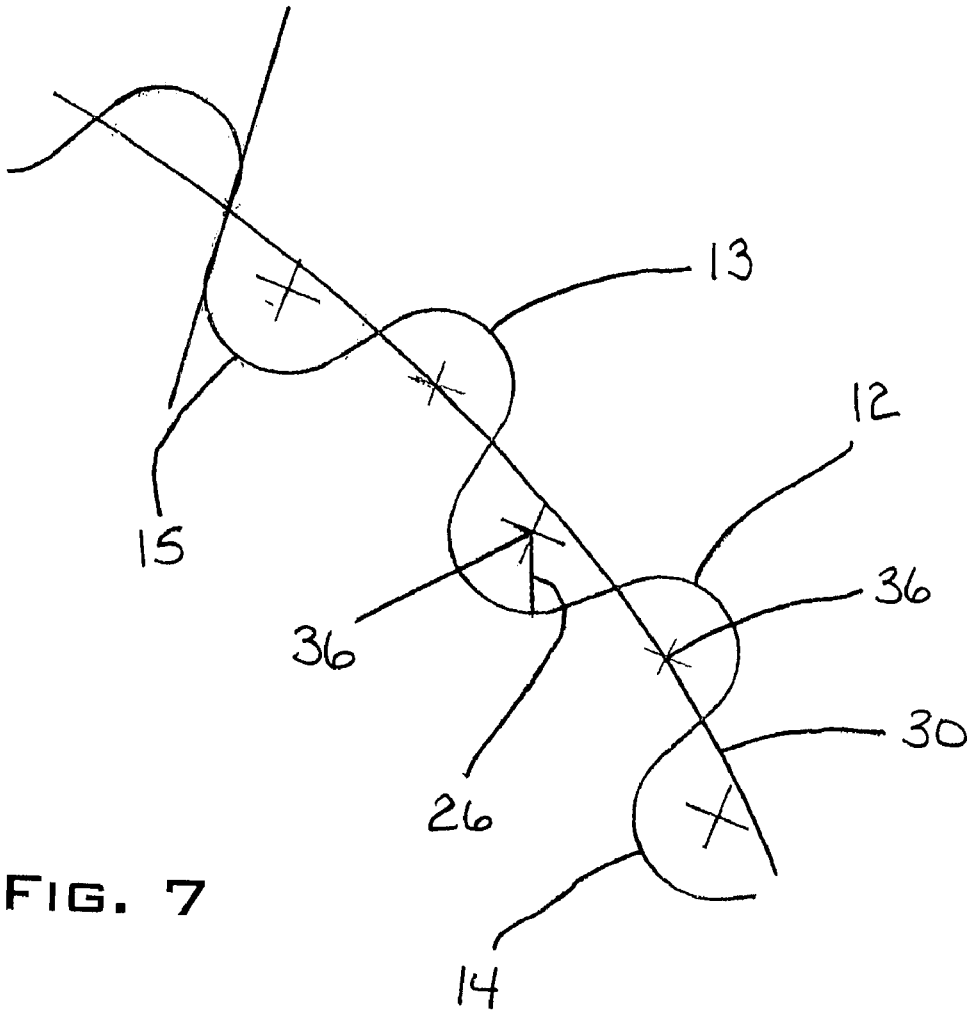
FIG. 7 is a magnification of the gear teeth of the present invention illustrating the gear root offset from the pitch curve.

FIG. 7 is a magnification of a portion of the wave tooth gear 10 illustrating the orientation of the gear teeth 12 and roots 14 with respect to the pitch curve 30. The points 36 of the gear roots 14 can be either positioned on or spaced from the pitch curve 30. Offsetting the root diameter from the pitch curve 30 can be used to reduce fluid compression in high viscosity applications and create more clearance to compensate for manufacturing and operating tolerances. It is understood that the root offset can be a value of zero and still result in a wave tooth. The amount of root offset is adjusted to the particular application and manufacturing process as discussed further below.

The gear pitch curve 30 or profile as shown in FIGS. 2, 4, 6 and 7, is an imaginary line curving around the gear that allows for the positioning of the teeth 12 and roots 14. Two meshing gears 12 have pitch curves 30 that contact at a line of tangency as shown in FIG. 4. Since the pitch curve 30 of the wave tooth gear 10 is non-circular, the linear distance between each tooth 12 within a single quadrant of the gear 10 varies due to the tangency locations along the pitch curve 30. The wave teeth 12 are not symmetrical about the axis that passes through the tip and the geometric center of the gear 10. In order to design the wave tooth gear 10 of a desired size and having a certain number of wave teeth 12, a length for the major and minor axes 16 and 18 must be decided upon for the overall dimensions of the gear 12. For example, a gear 12 is chosen having a major axis length of 1.2 inches and a minor axis length of 0.68 inches and further including 42 teeth. Once the lengths of the major and minor axes 16 and 18 are selected, coordinate points used for the creation of the non-circular pitch curve 30 need to be determined. The equation utilized to determine the coordinate points for the pitch curve 30 is the following:

$$r = \frac{2ab}{(a+b)-(a-b)\cos 2\Theta}$$

wherein: $r$ = is the radius of curvature at a given angle (active pitch radius)

$a$ = major axis (radius)

$b$ = minor axis (radius)

$\Theta$ = is an angle theta $\Theta$ in a range between 0° to 360°

The equation provided is only one method that can be used to determine an accurate pitch curve. Alternate equations known to those skilled in the art can also be used. In order to create the required coordinate points θ 360° is divided by a numerically high number (ie. 3,600,000) to arrive at over a million θ values. The use of a large amount of θ values allows for extreme accuracy when plotting the pitch curve 30. These θ values are entered into the equation to obtain a radius (r) for each θ interval. In the example, the first θ value would be 0.0001 and that value would be entered into the equation along with the major and minor axes values to obtain a first radius (r) value. The second θ value would be 0.0002 and would be entered into the equation along with the major and minor axis values to obtain a second (r) value. Once all of the points are calculated for each θ value to obtain the corresponding radius (r) valves, the radius (r) values are converted into x and y coordinates using the following trigonometric functions:

$$X=(\cos\theta)(r)$$

$$Y=(\sin\theta)(r)$$

The following are the first few coordinate points.

$1^{st}$ point X=1.2" and Y=0"

$2^{nd}$ point X=1.18 and Y=+0.01

$3^{rd}$ point X=−1.16 and Y=+0.02

Coordinate points are calculated for the entire log of radius (r) values until a pitch curve 30 can be generated. To draw the pitch curve 30, the coordinate points are interconnected by line segments. The gear profile (pitch curve) 30 would be drawn from the major axis 16 adding coordinate points counterclockwise toward the minor axis 18 as shown in FIG. 1. Once the pitch curve 30 is drawn, the total length of the pitch curve 30 is calculated. To calculate the length of the pitch curve 30, the line segments interconnecting the coordinate points that make up the pitch curve 30 are added together. In this example, the total pitch curve length would be 5.88 inches.

Once the total pitch curve length has been determined, the placement of the teeth 12 for a given quadrant 40 of the gear 10 is calculated. The other quadrants 42, 44 and 46 can be created after the positions of the teeth 12 and roots 14 in the first quadrant 40 have been determined by mirroring the first quadrant 40 over the other three quadrants 42, 44 and 46 as shown in FIG. 1. For a gear 10 with 42 teeth 12, the number of teeth 12 is multiplied by a factor of 2 to arrive at the number of points 36 required for placement of the 42 teeth 12 and 42 roots 14. A gear 10 with 42 teeth and 42 roots would require 84 points equally spaced along the pitch curve 30. The arc distance between each of the 84 points provides the tooth arc length 48, i.e. the theoretical perfect arc. The arc length 48 is defined as the distance between the center of one tooth 12 and the center of an adjacent root 14. The gear 10 having 42 teeth would include a total of 84 arc lengths. When initiating the placement of the teeth 12 and roots 14 along the pitch curve 30 of the gear 10, the center point of the first root 14 is positioned on the major axis 16. Alternatively, when initiating the placement of the teeth 12 and roots 14 along the pitch curve 30, the center point of the first tooth 12 can be positioned on the major axis 16. Adjacent teeth 12 and roots 14 are preferably added to the pitch curve in a counterclockwise direction, but it is not required. The arc length 48 is determined by dividing the perimeter by the value 84 which is the total number of points 36. The arc length 48 would be 5.88/84=0.07 inches. The coordinates for the placement of the first root 14 along the pitch curve 30 would be X=1.20 and Y=0.0. The arc length of the first root 14 along the major axis 16 would be 0×0.07=0 inches; the arc length for the first tooth 12 counterclockwise from the major axis 16 would be 1×0.07=0.07 inches; the arc length for the second root 14 from the major axis 16 would be 2×0.07=0.14 inches and so forth. Alternating points 36 from the major axis 30 are points for gear teeth 12.

Once the positions for the gear teeth 12 and roots 14 have been determined, the amount of root offset from the pitch curve, if needed, is determined. Gear root 14 offset is the repositioning the points 36 of the roots 14 inward of the pitch curve 30 to increase the distance between the roots 14 and teeth 12 of two meshing gears 10, as shown in FIG. 7. The depth of the root offset is based on radial runout (bearing clearance, manufacturing tolerances) and whether large particles are present in the fluid to be metered. For example, if pure water is to be metered, high precision bearings are used, and the gear manufacturing process is accurate the root offset approaches zero. If a fragmented liquid is to be metered, the root offset is increased to allow for the passage of the fragments through the meshing gears. The typical offset of the gear roots 14 from the pitch curve 30 is typically between 0.0 inches and 0.015 inches. The offset has been determined by modeling and testing and depends upon the type of bearing used and the intended use of the gear. Gears with ball bearings typically have zero root offset while gears with journal bearings typically have a root offset of 0.01 inches to prevent binding. If the root 14 is offset, it is offset normal to the pitch curve 30.

Once the data points for the orientation of the pitch curve 30 and the center points 36 for roots 14 and teeth 12 are collected, the data is exported as an electronic file into a computer aided drafting program where the wave tooth gear 10 is graphically illustrated.

When determining the size of the gear teeth 12 and roots 14 for the gear 10, the clearance between the root diameter and tip diameter must be determined. The clearance is determined by modeling and testing and is dependant upon the gear composition, the quality of the bearings and manufacturing process. The gears 10 can be fabricated out of metal such as steel or aluminum, from resin, plastic such as nylon, ceramics, composites or other materials known to those skilled in the art. The tooth 12 diameter of gear 10 would be 0.068 inches and the root diameter would be 0.072 inches, both deviating from the standard arc length 48 of 0.070 inches by 0.002 inches. Once the diameter of the teeth (0.068 inches) and roots (0.072 inches) are determined, the computer aided drafting program is used to draw the circles 50 for teeth 12. The wave teeth 12 are centered on the points 36 and have a diameter of 0.068 inches. The computer aided drafting program is also used to draw circles for the roots 14. The root circles are centered on the centerpoints 36 and have a diameter of 0.072 inches. Circles that form the roots 14 and teeth 12 closest to the major axis 16 are in contact with each other. Circles 50 that form the roots 14 and teeth 12 closest to the minor axis 16 are not in contact so lines of tangency must be drawn to create connecting lines between adjacent circles that make up the teeth 12 and roots 14. Once one quadrant 40 for the gear 10 is completed on the computer aided drafting program, the other three quadrants 42, 44 and 46 can be mirrored to complete the gear 10.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A non-circular gear comprising:

a hub having a major axis and a minor axis disposed perpendicular to said major axis, said major axis being longer than said minor axis;

a plurality of teeth radially extending from said gear at locations surrounding said hub;

a plurality of roots, each root positioned between adjacent teeth at locations surrounding said hub;

each of said teeth including a head portion shaped as an arc segment of a first radius and each of said roots including a recess shaped as an arc segment of a second radius; and whereby said teeth heads are joined to adjacent roots by lines of tangency.

2. The non-circular gear of claim 1, having a pitch curve, said first radius and said second radius centered on said pitch curve an equal arcuate distance between each said first and second radius.

3. The non-circular gear of claim 1, wherein said second radius is larger than said first radius.

4. The non-circular gear of claim 1, having a pitch curve, said first radius positioned on said pitch curve and said second radius positioned inwardly from said pitch curve.

5. The non-circular gear as in claim 1 in which each tooth includes centerpoint with the centerpoints of each tooth being spaced at the same arcuate distance from the centerpoints of adjacent teeth around the entire perimeter of said gear notwithstanding differences in lineal distances between adjacent centerpoints.

6. A flow meter comprising:

a housing;

an input port and an output port defined in said housing communicating with an enclosed chamber;

a first non-circular gear journaled for a rotation within said chamber;

a second non-circular gear journaled for rotation within said chamber, said non-circular gears having a plurality of wave teeth and a plurality of roots formed on a perimeter of said gears;

said wave teeth on said gears having a perimeter defined by a tooth arc segment, and said roots having a perimeter defined by a root arc segment; and said teeth heads being adjoined to adjacent roots by lines of tangency, said first and second gear meshing to provide a seal to inhibit the back flow of fluid in the meter.

7. The flow meter of claim 6, wherein said first non-circular gear is defined by a first pitch curve.

8. The flow meter of claim 7, wherein said tooth arc segment of said first gear is defined by a first radius and said root arc segment of said first gear is defined by a second radius.

9. The flow meter of claim 8, wherein said first radius is centered on said first pitch curve.

10. The flow meter of claim 9, wherein said second radius is centered interiorly of said first pitch curve.

11. The flow meter of claim 9, wherein said second radius is centered on said first pitch curve.

12. The flow meter of claim 6, wherein said second gear is defined by a second pitch curve.

13. The flow meter of claim 12, wherein said tooth arc segment of said second gear is defined by a first radius and said root arc segment of said second gear is defined by a second radius.

14. The flow meter of claim 13, wherein said first radius is centered on said second pitch curve.

15. The flow meter of claim 14, wherein said second radius is centered interiorly of said second pitch curve.

16. The flow meter of claim 13, wherein said second radius is centered on said second pitch curve.

17. The flow meter of claim 6 in which each tooth includes a centerpoint with the centerpoints of each tooth being spaced at the same arcuate distance from the centerpoints of adjacent teeth around the entire perimeter of said first gear notwithstanding differences in lineal distances between adjacent centerpoints.

18. A fluid transfer device comprising:

a housing;

a first non-circular gear positioned within said housing and having perpendicularly disposed major and minor axes and including a plurality of gear teeth having teeth heads and roots disposed about a first non-circular pitch curve, said gear roots defined by a perimeter edge shaped as an arc segment having a first radius and said gear teeth defined by a perimeter edge shaped as an arc segment having a second radius;

a second non-circular gear positioned within said housing and having perpendicularly disposed major and minor axes and including a plurality of gear teeth having teeth heads and roots disposed about a second non-circular pitch curve, said gear roots defined by a perimeter edge shaped as an arc segment having a first radius and said gear teeth defined by a perimeter edge shaped as an arc segment having a second radius; and said gears oriented so that said gear teeth of said first non-circular gear engage said gear teeth of said second non-circular gear.

19. The fluid transfer device of claim 18, wherein said gear root perimeter being joined to said adjacent gear tooth perimeter by lines of tangency.

20. The fluid transfer device of claim 18, wherein said first radius of said first non-circular gear is centered on said first non-circular pitch curve.

21. The fluid transfer device of claim 18, wherein said first radius of said second non-circular gear is centered on said second non-circular pitch curve.

22. The fluid transfer device of claim 18, wherein said first radius of said first non-circular gear is centered interiorly of said first non-circular pitch curve.

23. The fluid transfer device of claim 18, wherein the center of said first radius of said second non-circular gear is spaced apart from said second non-circular pitch curve.

24. A method of making a non-circular gear comprising the steps of:

selecting the length of the major and minor axes;

selecting a number of gear teeth;

determining the radius of curvature points for a plurality of angles ranging from 0° to 360° using the following equation:

$$r = \frac{2ab}{(a+b)-(a-b)\cos 2\Theta}$$

converting the radius of curvature points into X and Y coordinates using the following equations:

$$X=(\cos\Theta)(r)$$

$$Y=(\sin\Theta)(r)$$

plotting said X and Y coordinates and interconnecting said X and Y coordinates with line segments to form a pitch curve;

adding the length of said line segments together to determine said pitch curve length;

multiplying said number of teeth by a factor of 2 to determine a total number of centerpoints;

determining an arc length by dividing said pitch curve length by said total number of centerpoints;

drawing teeth and roots along said pitch curve, said teeth and root having diameters substantially equal to said arc length;

interconnecting said teeth and roots by lines of tangency.

25. The method of making a non-circular gear of claim 24 including the additional step of positioning the center of said teeth at said centerpoints on said pitch curve.

26. The method of making a non-circular gear of claim 24 including the additional step of positioning the center of said roots at said centerpoints on said pitch curve.

27. The method of making a non-circular gear of claim 24 including the additional step of positioning the center of said roots at said centerpoints inward of said pitch curve.

* * * * *